US006901996B2

(12) United States Patent
Gievers et al.

(10) Patent No.: US 6,901,996 B2
(45) Date of Patent: Jun. 7, 2005

(54) COOLANT/AIR HEAT EXCHANGER CORE ASSEMBLY

(75) Inventors: Josef Gievers, Borgentreich (DE); Frank Roelants, Rumst (BE)

(73) Assignee: Autokuehler GmbH & Co. KG, Hofgeismar (DE)

( * ) Notice: Subject to any disclaimer, the term of this patent is extended or adjusted under 35 U.S.C. 154(b) by 0 days.

(21) Appl. No.: 10/272,838

(22) Filed: Oct. 17, 2002

(65) Prior Publication Data

US 2003/0070795 A1 Apr. 17, 2003

(30) Foreign Application Priority Data

Oct. 17, 2001 (DE) ..... 101 51 238

(51) Int. Cl.[7] ..... F28F 3/06
(52) U.S. Cl. ..... 165/166; 165/170
(58) Field of Search ..... 165/168, 170, 165/166

(56) References Cited

U.S. PATENT DOCUMENTS

| | | | | | |
|---|---|---|---|---|---|
| 331,532 | A | * | 12/1885 | Nichols | 165/170 |
| 1,490,706 | A | * | 4/1924 | Madden | 165/168 |
| 1,571,599 | A | * | 2/1926 | North | 165/168 |
| 2,566,310 | A | * | 9/1951 | Burns et al. | 165/140 |
| 2,874,941 | A | * | 2/1959 | Woolard et al. | 165/170 |
| 4,353,416 | A | * | 10/1982 | Buschfeld | 165/168 |
| 4,434,845 | A | | 3/1984 | Steeb | |
| 5,098,514 | A | * | 3/1992 | Held | 165/168 |
| 6,044,902 | A | * | 4/2000 | Pahade et al. | 165/166 |

FOREIGN PATENT DOCUMENTS

| | | | | |
|---|---|---|---|---|
| BE | 1008176 | | 2/1996 | |
| DE | 842 359 | | 7/1949 | |
| DE | 3146088 | A1 * | 5/1983 | 165/166 |
| DE | 41 18 289 | A1 | 12/1992 | |
| DE | 195 18 511 | A1 | 11/1995 | |
| DE | 692 09 994 | T2 | 9/1996 | |
| DE | 195 47 928 | A1 | 1/1997 | |
| DE | 29822888 | | 2/1999 | |
| DE | 199 00 846 | A1 | 7/1999 | |
| EP | 0 521 298 | A2 | 1/1993 | |
| FR | 929698 | | 1/1948 | |
| FR | 1302612 | | 8/1962 | |

* cited by examiner

*Primary Examiner*—Leonard R. Leo
(74) *Attorney, Agent, or Firm*—Michael J. Striker

(57) ABSTRACT

A coolant/air heat exchanger core assembly (1) is described, having at least one meandering or serpentine coolant passage and an air passage between superimposed plates. The coolant passage is formed by a plurality of channels (34) which are bounded at the sides by the webs or flanges of profiles (33) with an I-shaped or U-shaped cross-section and are connected together at their ends by diverting sections (36) (FIG. 4).

8 Claims, 5 Drawing Sheets

COOLANT/AIR HEAT EXCHANGER CORE ASSEMBLY

TECHNICAL FIELD

This invention relates to a coolant/air heat exchanger core assembly with at least two plates, between which a coolant passage and an air passage are formed, wherein the coolant passage has a plurality of channels which are bounded at the sides by partitions arranged perpendicular to the plates and fixed to these by soldering and which are so connected together at their ends in serpentine or meandering form by diverting sections that coolant passes through them one after the other.

BACKGROUND OF THE INVENTION

Heat exchanger devices produced with heat exchanger cores or core assemblies of this kind are needed for example in compressed air installations for extracting the moisture from compressed air created by means of a compressor and under a pressure of e.g. 25 bar, in order to make the air suitable for critical applications, such as in the foodstuffs and paper industries or the medical field. The drying of the air is effected in that the heated air arriving from the compressor is passed—after passage through an after-cooler—through a device which includes an air/air and a coolant/air heat exchanger. While the air/air heat exchanger is mostly manufactured in the form of a plate heat exchanger of conventional construction, the coolant/air heat exchanger mostly consists of a combined tube/plate heat exchanger with a core which has air passages and intervening coolant passages formed by plates and bars holding these spaced apart. The coolant passages each consist for example of tubes of round or square cross-section arranged between two plates, with straight sections and diverting sections connecting these in serpentine or meandering form (EP 0 521 298 A2).

The serpentine or meandering disposition of the tubes for the coolant gives the advantage that the coolant is circulated through heat exchanger core instead of, as usual, flooding the core, i.e. the coolant circulates through the straight tube sections one after the other and not in parallel. However, a disadvantage of this construction is that unused spaces result between the individual tube sections, which results in the length of the coolant/air beat exchanger core mostly having to be made greater than the length of the air/air heat exchanger grid. Moreover the curved diverting sections lie as a rule outside the space occupied by the actual core, so that they do not participate in the heat exchange.

In addition it has already been proposed (likewise EP 0 521 298 A2) to replace the passages through which the coolant flows by tube and diverting sections, produced in the conventional plate construction in which the tube and diverting sections are bounded by conventional bars running in transverse and longitudinal directions, arranged between the plates. Circulation through the core is indeed likewise achieved with such an arrangement. However, a disadvantage is that either comparatively thick bars have to be provided, in order to provide sufficiently large soldering areas for stable soldered joints, so that reduced flow cross-sections are obtained for given overall dimensions of the core, or narrow bars have to be used, which favour good flow cross-sections, but comparatively small soldering surfaces have to be taken into account. A consequence of this is that overall a compromise always has to be found between the cross-section of the coolant passages and the size of the soldering areas and the strength of the heat exchanger core which can be obtained thereby. In view of the fact that for many applications burst pressures for the core of 100 bar and more have to be provided, it follows that the overall dimensions of the heat exchanger core are affected substantially by the thickness of the bars bounding the channels.

In the ligth of the above it is an object of this invention of so forming the coolant/air heat exchanger assembly of the kind above specified that it can be produced with the required strength using cost effective manufacturing processes.

A further object of this invention is to design the heat exchanger core assembly mentioned above such that it can be manufactured without remarkable problems by means of usual soldering.

Yet another object of this invention is to provide the core assembly mentioned above with comparatively large flow cross-sections for the coolant with given overall dimensions.

SUMMARY OF THE INVENTION

These and other objects are solved according to this invention in that the partitions are formed by webs and/or flanges of profiles with I and/or U shaped cross-sections arranged between the plates.

Because of the use according to the invention of the webs and/or flanges of profiles to form the partitions between the coolant channels, greater flow cross-sections of the coolant passages tan previously can be realised for given dimensions of the heat exchanger core, without having to take into account reduced strength with the use of conventional soldering methods, especially salt bath soldering.

Further advantageous features of the invention appear from the dependent claims.

BRIEF DESCRIPTION OF THE DRAWINGS

The invention will be explained below in more detail with reference to embodiments, in conjunction with the accompanying drawings, in which.

DETAILED DESCRIPTION OF THE INVENTION

Figure 1:
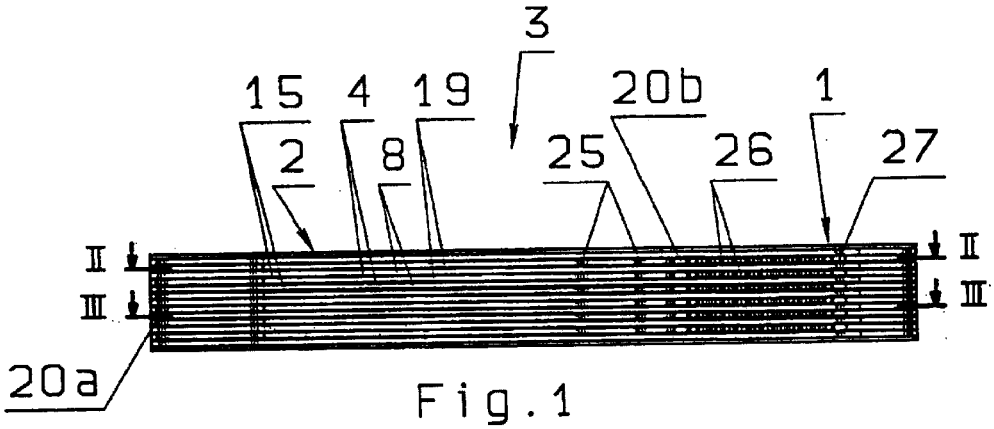
FIG. 1 is a schematic front view of a combined coolant/air and air/air heat exchanger block for cold driers in compressed air installations.
Figure 2:
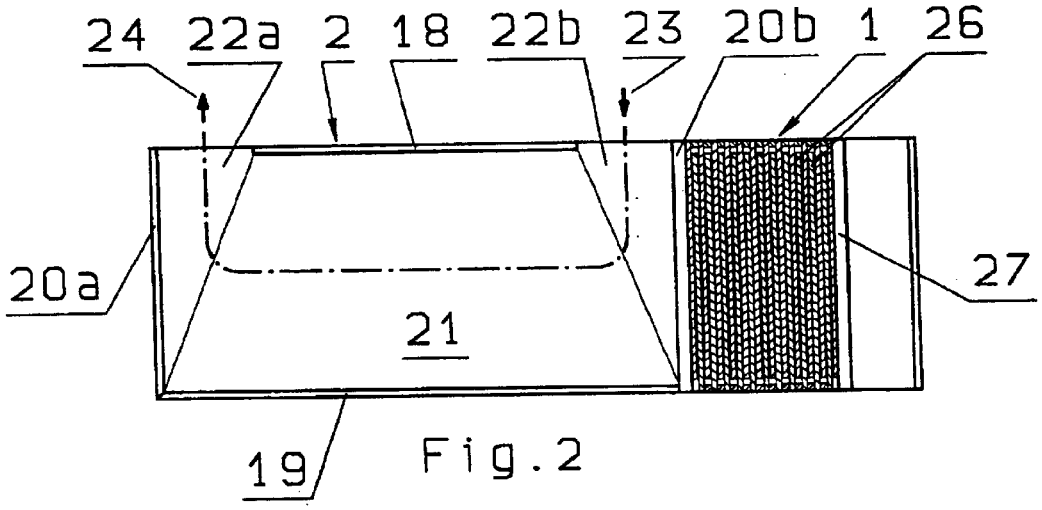
FIGS. 2 and 3 are sections along the lines II—II and III—III in FIG. 1.
Figure 3:
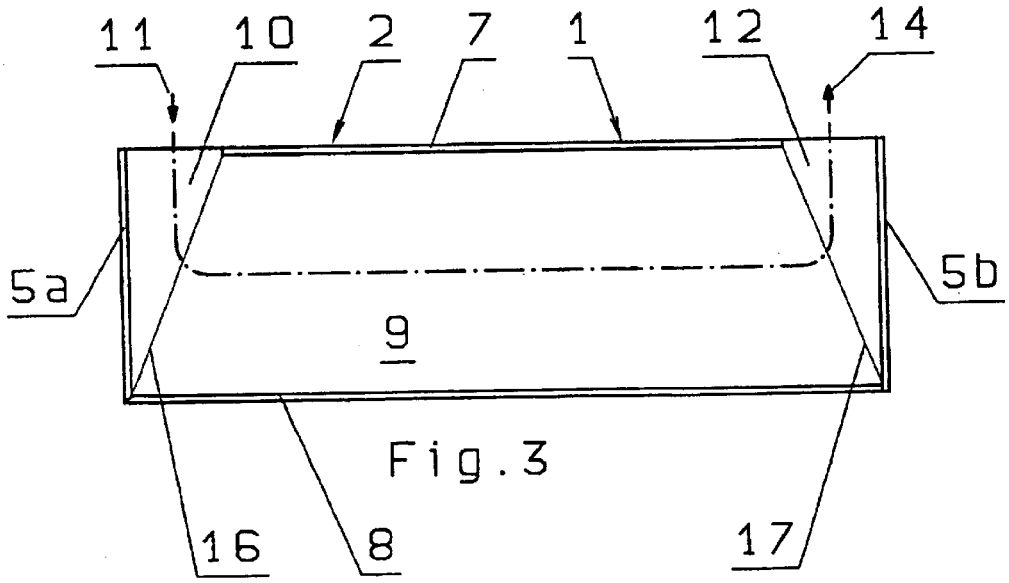

According to FIGS. 1 to 3 a heat exchanger device for cold driers in compressed air installations includes a coolant/air heat exchanger in the right part and an air/air heat exchanger in the left part. Only one coolant/air heat exchanger net or core 1 and one adjoining air/air heat exchanger net or core 2 are shown, the two being combined in an integral core assembly and forming a single, unitary block 3. Naturally it would alternatively be possible to manufacture and operate the two cores 1 and 2 as separate components.

The two cores 1 and 2 are mainly formed by plane-parallel, rectangular or square plates 4, which extend over the whole width and length of the block 3. According to FIGS. 1 and 3 a part of the plates 4 are held spaced in pairs on the one hand by bars 5*a* and 5*b* running perpendicular to the longitudinal direction and arranged at ends of the block 3 at the right and left in FIG. 3 and on the other hand by bars 7, 8 extending in the longitudinal direction and disposed at the side edges of the plates 4. Passages 9 thus result between these plates 4. At the left end in FIG. 3 the upper bars 7 are somewhat shorter, so that spaces 10 result between their left ends and the bars 5*a*, through which air can enter from the side in the direction of an indicated arrow 11. Correspondingly the upper bars 7 are somewhat shorter at the right end in FIG. 3, so that spaces 12 result between their right ends and the bars 5*b*, through which the air can emerge to the side in the direction of the indicated arrow 14. Customary lamellae 15 shown only partially in FIG. 1 are moreover advantageously fitted in the passages 9 and their passages are diverted along the lines 16, 17 by 90° in accordance with FIG. 3.

The other part of the plates 4 are held spaced apart in pairs, according to FIGS. 1 and 2, in the part forming the core 2, by bars 18 and 19 running parallel to the longitudinal direction and arranged at the side edges of the plates 4 and extending up to the left end of the core 1 in FIGS. 1 and 2, as well as terminating bars 20*a* and 20*b* running transversely to the former and forming the left and right ends of the core 2. Accordingly a further passage 21 results between each two plates 4. At the sides of the terminating bars 20*a* and 20*b* the upper bars 18 in FIG. 2 are somewhat shorter, so that spaces 22*a*, 22*b* result between them and the two bars 20*a*, 20*b*, through which air can enter and leave at the side and be fed in and out in the direction of the indicated arrows 23, 24 (FIG. 2). The deflection is like in FIG. 2 preferably effected by suitably formed lamellae 25 provided in the passages 21.

In the core 1 the same plates 4 which bound the passages 21 serve to form serpentine or meandering passages 26, which comprise straight sections and sections serving for the diversion and which are explained in more detail below. The passages 26 each extend from one of the terminating bars 20*b* to a terminating bar 27, which is located at the right end in FIGS. 1 and 2 of the block 3. Plate pairs with the passages 9 and plate pairs with the passages 21, 26 preferably alternate in superimposed planes, where at least one each of the passages 9, 21, 26 is provided. A coolant is fed into the passages 26 at an inlet denoted by an arrow 28 and can flow out again at an outlet indicated by an arrow 29 and flows through a coolant circuit, not shown.

The inlets and outlets denoted by the arrows 11, 12, 23, 24 and 28, 29 are connected to inlet nipples, collecting tanks or the like, not shown, known per se.

The manner of operation of the described heat exchanger device is essentially as follows:

The compressed air arriving from a compressed air installation, heated to about 35–55° C. for example, is fed in in the direction of the arrow 11, so that it flows through the passages 9. The air is first cooled to a temperature of 20° C. in the core 2 by the cold air arriving from a water separator, fed in counterflow in the direction of the arrow 23. In its further travel through the passages 9 the compressed air is gradually cooled to its dew point in the core 1, since it here interacts with the coolant, which flows into the passages 26 in the direction of the arrow 28 (FIG. 2). The compressed air is then taken off at the outlet denoted by the arrow 14 (FIG. 3) and fed to a water separator, not shown, from whence it is fed into the core 2 at the arrow 23 and taken off at the outlet denoted by the arrow 24, which serves as a tapping point for the compressed air. The arrangement is so designed that the air is again heated to approaching room temperature at the tapping point.

Heat exchanger devices of the kind described and their manner of operation are generally known to the man skilled in the art (EP 0 521 298 A2) and therefore do not need to be explained in more detail.

Figure 9:
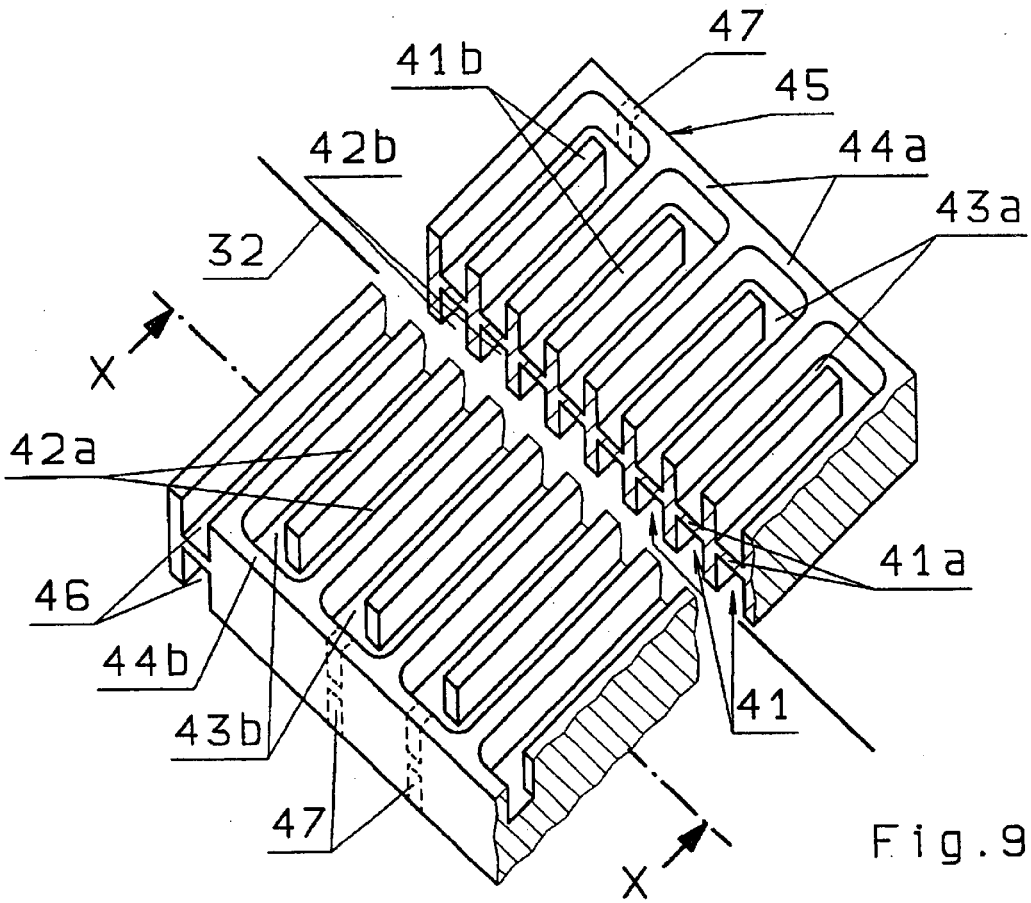
FIG. 9 shows schematically a plate forming a coolant passage, for a heat exchanger core according to FIGS. 1 to 3, in a partially broken away, perspective view.

In a preferred and so far regarded as the best embodiment of the invention, each coolant passage for the core/part 1 of the coolant/air heat exchanger is formed by a plurality of channels connected for flow one after the other, arranged in each case between two plates 4 and produced with the aid of individual profiles with an I-shaped cross-section arranged parallel alongside one another. As an alternative to this, a second embodiment for the core is shown in FIG. 9, in which the channels are formed from I-shaped profiles connected together in one piece and arranged one after the other.

Figure 4:
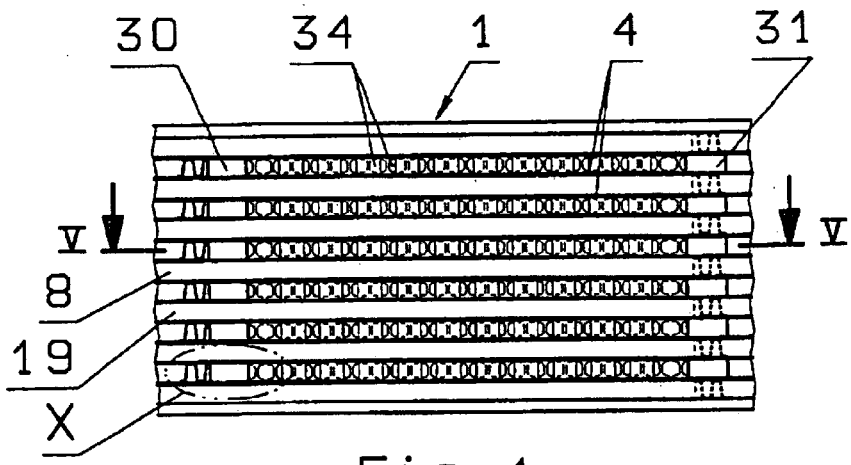
FIG. 4 is an enlarged front view of the core of the block according to FIG. 1 provided for the coolant/air heat exchange.
Figure 5:
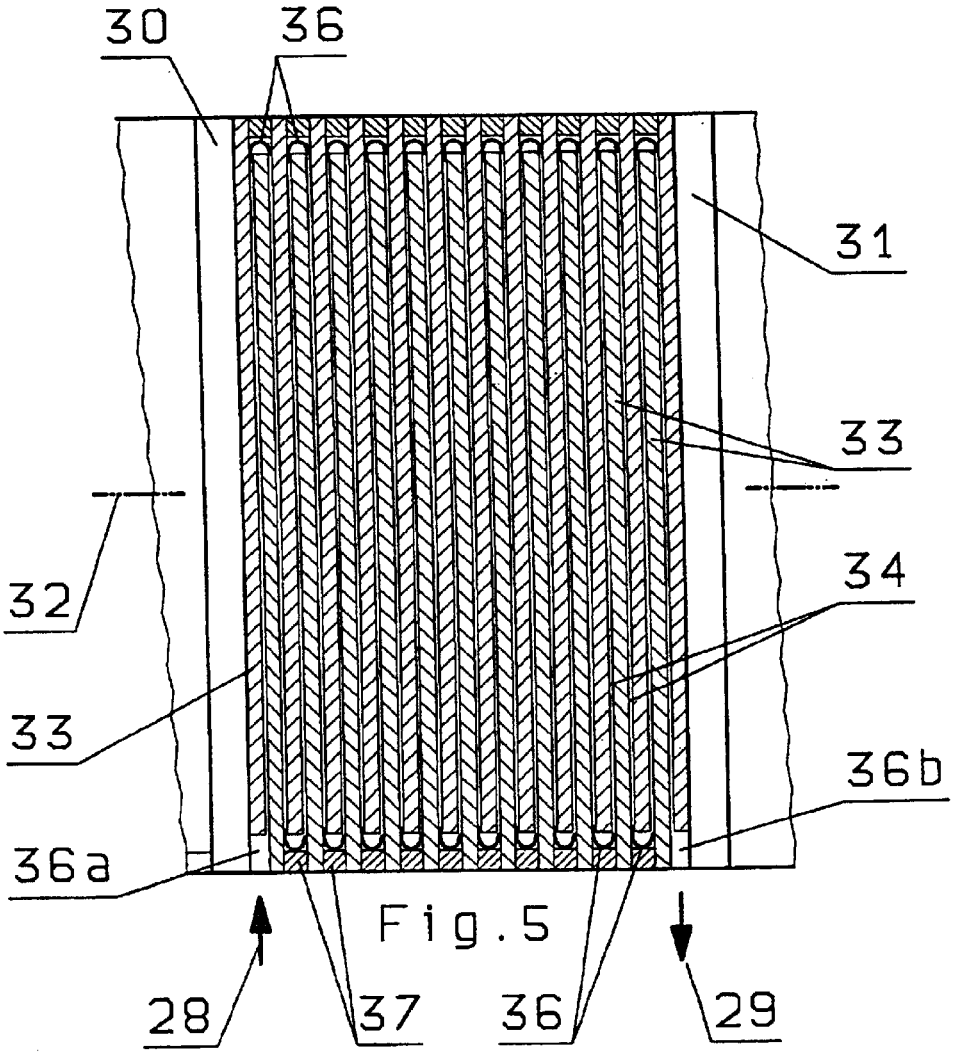
FIG. 5 is a section along the line V—V of FIG. 4.
Figure 6:
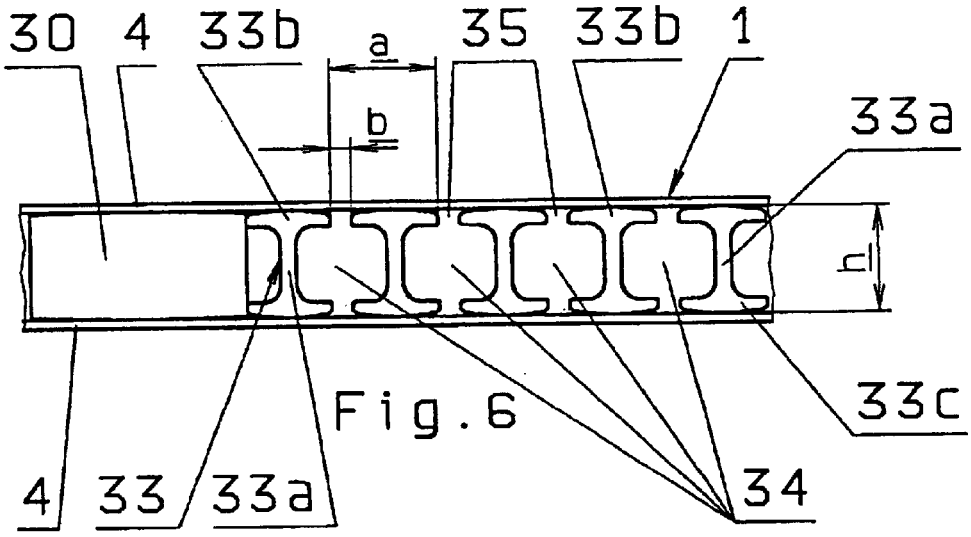
FIG. 6 is a further enlarged front view of a portion X of a single coolant passage of the core according to FIG. 4.

As FIGS. 4 and 5 in particular show, the plates 4 of each associated pair are held spaced apart by bars 30 and 31, which extend transverse to a longitudinal axis 32 of the core 1 and have a square or rectangular cross-section, in order to form plane parallel hollow spaces therebetween. The bar 30 can correspond to the bar 20*b* according to FIG. 2. In between the plates 4 of each of these pairs are moreover arranged a plurality of profiles 33 with I-shaped cross-sections, seen especially in FIGS. 6 and 8, which comprise webs 33*a* extending perpendicular to the longitudinal axis 32 and to the plates 4 and are arranged parallel to one another. At both ends of each web a strip or flange 33*b*, 33*c* is arranged perpendicular to the webs 33*a*. The heights h of the profiles 33 (FIG. 6) correspond to the heights of the bars 30 and 31, so that outer surfaces 33*d*, 33*e* (Pig. 8) of the flanges 33*b*, 33*c* bear against the plates 4 disposed above and below them in the assembled state. Accordingly, a plurality of channels 34 are provided between the plates 4 as FIG. 6 in particular shows, which channels 34 extend substantially perpendicular to the longitudinal axis 32. The channels 34 are each bounded at the sides by two webs 33*a* and above and below by the associated flanges 33*b*, 33*c* of the profiles 33. The spacings a (FIG. 6) of the profiles 33 are preferably made so large that spaces 35 each with a width b remain between the facing edges of their flanges 33*b*, 33*c*, so that the channels 34 are bounded there not by the flanges 33*b*, 33*c* but by portions of the plates 4 bridging over the flanges 33*b* and 33*c*. Finally the surfaces 33*d*, 33*e* (FIG. 8) are preferably slightly domed convexly outwards for reasons explained below.

Figure 7:
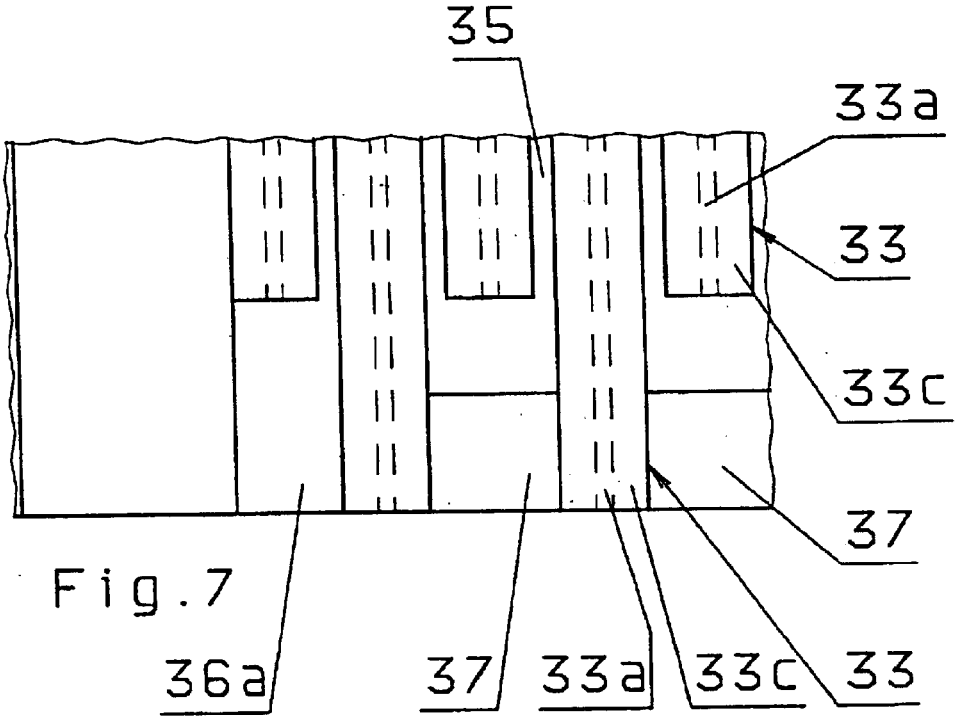
FIG. 7 is a plan view of the coolant passage according to FIG. 6 with omission of an upper plate.

As FIGS. 5 and 7 show in plan view, the profiles 33 are preferably of the same length in their longitudinal direction running perpendicular to the longitudinal axis 32 but are alternately offset forwards and rearwards relative to one another. The arrangement is such that the one end of a first profile 33 neighbouring the bar 30 is arranged at a certain spacing from the lower edge in FIG. 7 of the associated plate 4, while the other end terminates flush with the upper edge of the plate 4 in FIG. 5. The same applies to the following third, fifth, etc., profiles 33. Conversely, the intervening profiles 33, i.e. the second, fourth, etc., profiles are so offset relative to the profiles with odd numbers that they terminate with their ends flush with the lower edges of the plates 4 in FIGS. 5 and 7, while their opposite ends terminate spaced from the respective upper edges of the plates 4. Accordingly free spaces or diverting sections 36 result alternately at the one and the other plate edges and connect together the parallel channels 34 at their upper and lower ends in FIG. 5, into a serpentine or meandering passage for the flow.

At the ends of each of the first and last profiles 33 one of the diverting sections 36*a*, 36*b* serves for connection of a connecting nipple, collecting tank or the like, in order to feed the coolant thereby in and out in the direction of the arrows 28, 29 (FIG. 5). The other diverting sections 36 are bounded or closed to the outside by plugs 37, which have a height corresponding to the height h (FIG. 6) and a width which is advantageously substantially equal to the difference of twice the spacing a and the width of a web 33*a* in FIGS. 6 and 7, or equal to the sum of twice the width of the flanges 33*b*, 33*c* and twice the width b less the width of a web 33*a* and should at least be equal to the sum of the spacing a and the width b of a space 35. The plugs 37 each lie in a space which is bounded on the one hand by the webs 33*a* and by the plates 4 and on the other hand by the facing ends of the flanges 33*a*, 33*b* of those profiles which adjoin the one or the other edge of the plates 4. The plugs 37 bear both on the plates 4 and the webs 33*a* as well as on the ends of the flanges 33*b*, 33*c*.

The fixing, of the various parts to one another is preferably effected by soldering in a salt bath. In order that the flux, salt solutions and solder employed, air and like can flow into the channels 34 unimpeded, penetrate from thence into the gaps between the plates 4, profiles 33 and plugs 37 and also flow out again without impediment, channel sections present between the plugs 37 and the profiles 33 preferably remain open until completion of the soldering operation. At the conclusion of the soldering operation and complete running out of the fluids, these channel sections are then closed, preferably by a welding operation. This can be carried out without problems in view of the comparatively small space remaining (e.g. a=10 mm, b=2 mm, h=10 mm).

The plates 4, profiles 33 and plugs 37 preferably consist of aluminium. In order to braze these parts to one another, the plates 4 and plugs 37 preferably have layers plated with a suitable solder at the corresponding surfaces, as is generally known in the production of aluminium coolers for example. The soldering operation is moreover facilitated in that the surfaces 33*d*, 33*e* of the flanges 33*b*, 33*c* are slightly arched or rounded, since wedge gaps result from this when they abut the flat plate surfaces, which gaps ensure a large area wetting of the connecting parts.

The I-shaped cross-section of the profiles 33 has the substantial advantage that on the one band comparative large surfaces 33*d*, 33*e* (FIG. 8) available for the soldering operation are obtained at the ends of the profiles 33 and on the other hand the cross-sections of the profiles 33 are comparatively small in the middle part and accordingly the cross-sections of the channels 34 bounded thereby are comparatively large. Accordingly there are achieved on the one hand a high pressure tightness of the passages formed by the channels 34 and diverting sections 36 and on the other hand a high efficiency of the heat exchange, because a larger flow cross-section can be provided in a narrow space. On account of the high packing density of the channels 34 the width of the coolant/air heat exchanger core 1 can be substantially shorter that hitherto and thus the complete device of air/air and coolant/air heat exchanger can be made substantially more compact and smaller.

The individual parts needed moreover for completion of the cores 1 and 2 are not shown in the drawings, because they are formed in conventional manner. This applies in particular to upper and lower end plates 39 (FIG. 1) and the required connection nipples or collecting tanks.

Moreover it follows from FIGS. 1 and 4 that, in the right part, i.e. in the core assembly 1, the passages 9 formed from pairs of plates 4, the bars 5*a*, 5*b*, 7 and 8 and the lamellae 15 alternate with those passages 34 formed from the I profiles 33, further pairs of plates 4 and the plugs 37. In the left part however, i.e. in the core assembly 2, the passages 9 alternate with the passages 21 formed from the same pairs of plates 4, the bars 18, 19, 20*a*, 20*b* and the lamellae 25. How many passages 9, 21 and 34 are each present depends on the requirements of the individual case, while in principle one each of the passages 9, 21 and 34 suffices to enable the function described with reference to FIGS. 1 to 3.

According to a second embodiment of the invention shown in FIG. 9, the passages 34 (FIG. 6) are not formed from individual I profiles 33 arranged beside each other, with their webs 33*a* forming the side partitions of the individual channels, but from a plurality of rigidly united I profiles 41 arranged one after the other. Webs 41*a* of the profiles 41 form intermediate bottoms while flanges 41*b* having outer surfaces adjoining or merging into each other, form side partitions between channels 42*a* and 42*b* arranged transverse to the longitudinal axis 32 and parallel to one another. As in the embodiment according to FIGS. 1 and 8 the profiles 41 are offset relative to one another in their longitudinal direction, and the channels 42*a* and 42*b* are connected at their ends on the one and other longitudinal side by diverting sections 43*a* and 43*b* respectively, in meandering or serpentine form the diverting sections 43*a* are bounded on the outside by wall sections 44*a* whereas the diverting sections 43*b* are bounded by wall sections 44*b* which both are connected on each longitudinal side only to each second flange 41*b*, while the intervening flanges 41*b* end in front of these wall sections 44*a*, 44*b*, for the formation of the diverting sections 43*a*, 43*b*, so that the individual partitions are offset from one another by analogy with FIGS. 1 to 8, transverse to the longitudinal direction 32 and relative to one another. FIG. 9 moreover shows that, on account of the special arrangement a plurality of corresponding channels 43*a* and 42*b* result in each case on the two sides of the webs 41*a* or intermediate bottoms, being connected one after the other in terms of flow by the diverting sections 43*a*, 43*b* and forming a passage for the coolant. The channels are covered and closed above and below by the plates 4 by analogy with FIGS. 1 to 8 (FIG. 10), which are connected to the side edges of the flanges 41*b* by soldering.

Figure 10:
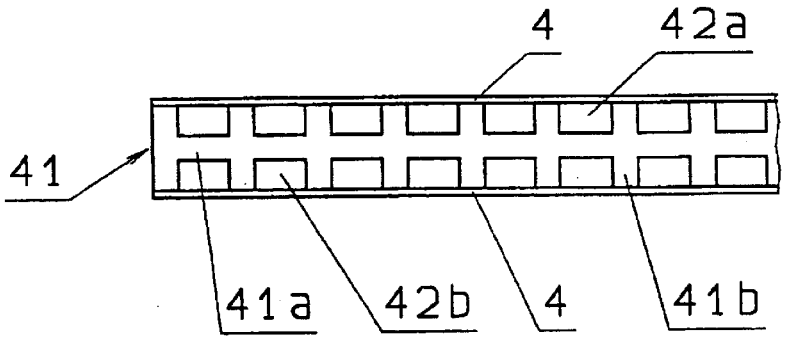
FIG. 10 is a section along the line X—X of FIG. 9.

The production of the passages seen in FIGS. 9 and 10 is effected in accordance with the invention in that a workpiece 45, e.g. a plane parallel plate, is provided with grooves on its two wide faces, forming the channels 42*a*, 42*b* and diverting sections 43*a*, 43*b*. This can be effected in particular by milling, especially track milling, so that the whole passage consisting of channels 42*a*, 42*b* and diverting sections 43*a*, 43*b* is produced in one working step. In this case the flanges 41*b* are obtained as wall sections remaining between the grooves and the webs 41*a* as remaining groove bottoms, where all these bottoms lie in one plane, which forms an intermediate bottom extending over the length and breadth of the workpiece 45, from which each of the flanges 41*b* extends with a half upwards and with another half downwards respectively. Alternatively it would be possible to form the grooves in only one surface of the workpiece 45, in which case only an essentially U-shaped profiling would result in a cross-section through the workpiece 45 along the longitudinal axis 32. The coolant passage could then be thought of as composed of a plurality of adjacent U-shaped profiles, whose side limbs adjoin or merge into one another. In each case the part forming the coolant passage forms a unitary I-shaped or. U-shaped profiled workpiece, which is connected on one or both sides by soldering to the plates 4 in order to close in the channels 42*a*, 42*b* and diverting sections 43, 43*b* initially open on the upper and/or lower side.

At the places associated with the arrows 28, 29 (FIG. 5) the grooves are extended through the wall parts 44*a*, 44*b*, as is indicated by a reference numeral 46 in FIG. 9, so that collecting chambers or the like, not shown, for the feed and discharge of the coolant can be fitted on their outsides.

In order that the soldering can be carried out cost-effectively in a salt bath, as in the embodiment of FIG. 1, the wall sections 44*a*, 44*b* are advantageously provided before the soldering operation with slots 47, which are indicated in broken lines at some places in FIG. 9 and which connect the diverting sections 43*a*, 43*b* with the outside of the wall sections 44*a*, 44*b*, i.e. pass through these. Accordingly air and fluids can easily penetrated into the channels 42*a*, 42*b* in the soldering operation, in order to wet the parts to be soldered in the region of the soldering gaps which are foxed, and can also easily flow out of the channels 42*a*, 42*b* after the soldering process. At the end of this the slots 47 are closed by a welding operation.

Figure 8:
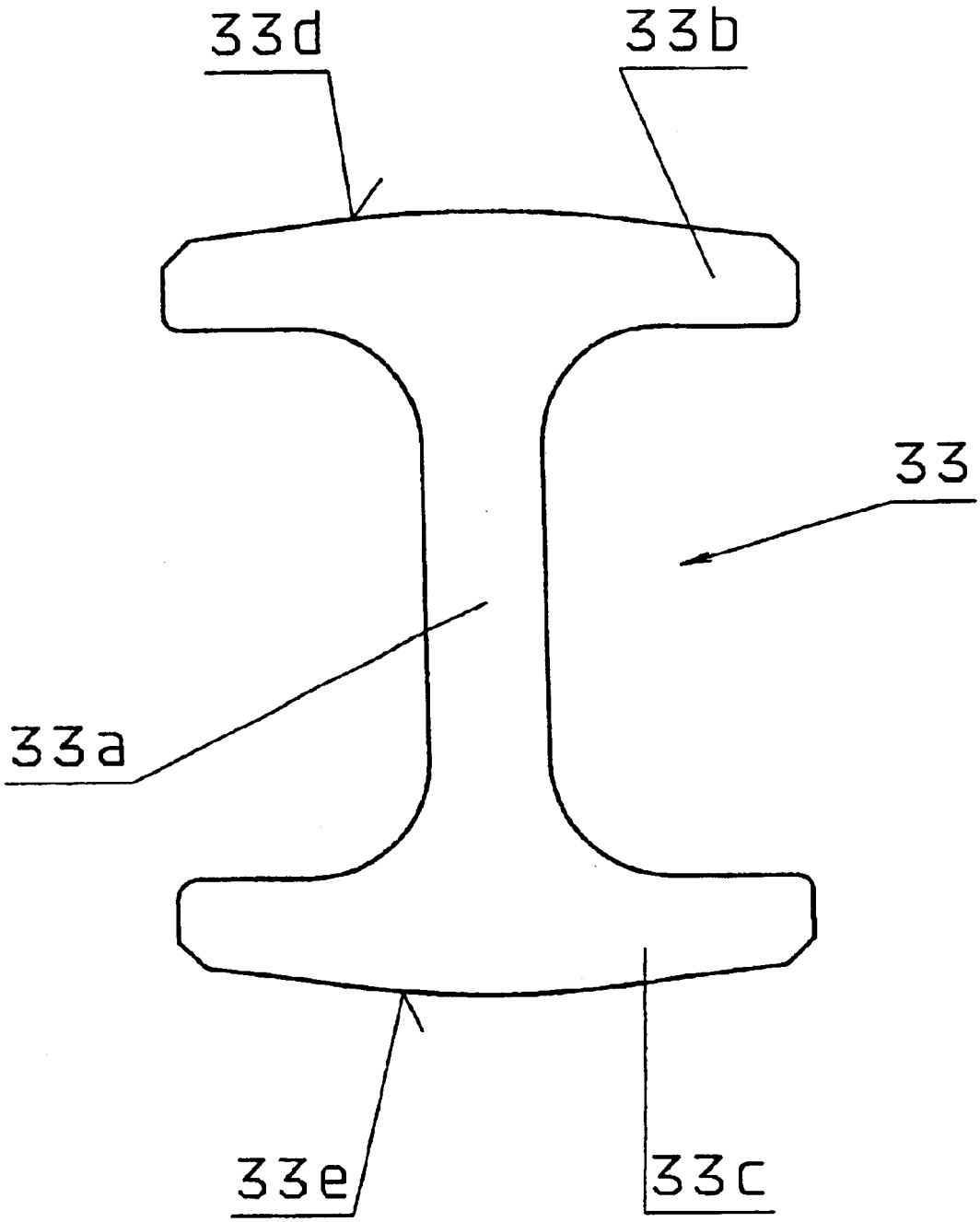
FIG. 8 is a front view in greater magnification of a single I profile of the coolant passage according to FIGS. 6 and 7.

The formation of the core assembly (FIG. 1) described with reference to FIG. 8 also leads to a high strength construction, which can withstand high burst pressures.

The invention is not restricted to the described embodiments, which can be modified in many ways. This applies in particular to the cross-sections shown in the drawings of the I and U profiles, which can have other shapes and can also be provided in combination. The invention is furthermore not limited to the use of aluminium as the material, since numerous other materials suitable for this purpose can be used for the production of the described heat exchanger core assembly. Furthermore it is immaterial in principle whether the cores 1 and 2 form an integral component by use of the continuous plates 4, are separately produced and then joined together in an integral component or are used as separate components, which are connected together by suitable lines. Moreover it would also be possible to arrange the two cores 1 and 2 one over the another in a manner known per se, instead of alongside each other. Finally it is obvious that the various features can be used in combinations other than those described and illustrated.

It will be understood that each of the elements described above, or two or more together, may also find a useful application in other types of constructions differing from the types described above.

While the invention has been illustrated and described as embodied in a heat exchanger core assembly, particularly a coolant/air heat exchanger core assembly, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A coolant/air heat exchanger core assembly, comprising: a plurality of plates (4) and at least a coolant passage and an air passage being formed between said plates (4), said coolant passage having a plurality of channels (34, 42) being bounded at the sides by partitions arranged perpendicular to said plates (4) and said air passages (9) being bounded by bars (5*a*, 5*b*, 7, 8) arranged between and facing said plates (4), said partitions and bars being fixed to said plates (4) by soldering, and a plurality of diverting sections (38, 43) connecting ends of said channels (34, 42) in serpentine or meandering form such that coolant can pass through them one after the other, wherein said partitions are formed by webs (33*a*) and/or flanges (41*b*) of profiles (33, 41) with I and/or U shaped cross-sections arranged between said plates (4) wherein said diverting sections (36) are formed by offset of said I profiles (33) affected on longitudinal direction, and wherein plugs (37) are provided for bounding said diverting sections (36) at outside portions thereof, said plugs (37) being connected by soldering to flanges (33*b*, 33*c*) and plates (4), and wherein channel sections remaining between said plug (37) and said webs (33*a*) of each second I profile (33) are closed by welding.

2. A heat exchange core assembly to claim 1, wherein said partitions are formed by webs (33*a*) of I profiles (33) arranged substantially perpendicular to said plates.

3. A heat exchange core assembly according to claim 1, wherein said flanges (33*b*, 33*c*) of said profiles (33) have outsides and are provided with convexly curved surfaces (33*d*, 33*e*) on said outsides.

4. A heat exchange core assembly according to claim 1, wherein said partitions are arranged substantially parallel to one another.

5. A heat exchange core assembly according to claim 1, wherein spaces (35) are provided between said flanges (33*b*, 33*c*) of adjacent I profiles (33).

6. A heat exchanger core assembly according to claim 1 and further composing a plurality of superimposed coolant passages and air passages between said coolant passages.

7. A heat exchanger core assembly according to claim 1 and being formed as part of a combined coolant/air and air/air heat exchanger block (3).

8. A heat exchanger core assembly according to claim 7, wherein said plates (4) have two sections, wherein one section forms said coolant/air heat exchanger core (1) and another section forms said air/air heat exchanger core (2).

* * * * *